US011255111B2

(12) United States Patent
Brunet-Lugardon et al.

(10) Patent No.: US 11,255,111 B2
(45) Date of Patent: Feb. 22, 2022

(54) ELECTRONIC PUSH BUTTON FOR A MOTOR VEHICLE DOOR HANDLE WITH ACTIVATION PATTERN MADE UP OF STUDS

(71) Applicants: Continental Automotive France, Toulouse (FR); Continental Automotive GmbH, Hannover (DE)

(72) Inventors: Florian Brunet-Lugardon, Seilh (FR); Pascal Perrot, Auzielle (FR); Michel Collet, Toulouse (FR)

(73) Assignees: Continental Automotive France; Continental Automotive GmbH

( * ) Notice: Subject to any disclaimer, the term of this patent is extended or adjusted under 35 U.S.C. 154(b) by 0 days.

(21) Appl. No.: 16/488,641

(22) PCT Filed: Apr. 10, 2018

(86) PCT No.: PCT/FR2018/050899
§ 371 (c)(1),
(2) Date: Aug. 26, 2019

(87) PCT Pub. No.: WO2018/206869
PCT Pub. Date: Nov. 15, 2018

(65) Prior Publication Data

US 2020/0386017 A1 Dec. 10, 2020

(30) Foreign Application Priority Data

May 12, 2017 (FR) ..... 1754182

(51) Int. Cl.
*E05B 81/76* (2014.01)
*H01H 3/12* (2006.01)
*H01H 13/14* (2006.01)

(52) U.S. Cl.
CPC ..... *E05B 81/76* (2013.01); *H01H 3/12* (2013.01); *H01H 13/14* (2013.01); *H01H 2229/044* (2013.01)

(58) Field of Classification Search
CPC .... H01H 3/12; H01H 13/14; H01H 2229/044; H01H 2221/088; E05B 81/76
(Continued)

(56) References Cited

U.S. PATENT DOCUMENTS 5,646,461 A * 7/1997 Kubota ..... H01H 13/702 307/116
6,274,825 B1 * 8/2001 Aaltonen ..... H01H 13/7006 200/5 A
(Continued)

FOREIGN PATENT DOCUMENTS

CN 102598026 A 7/2012
CN 104149260 A 11/2014
(Continued)

OTHER PUBLICATIONS

English Translation of the Written Opinion for International Application No. PCT/FR2018/050899, dated Jul. 17, 2018, 7 pages.
(Continued)

*Primary Examiner* — Lheiren Mae A Caroc
(74) *Attorney, Agent, or Firm* — RatnerPrestia

(57) ABSTRACT

An electronic push button for a motor vehicle door handle, including an activation pattern supported by a membrane that is flexible in the direction of an electric switch carried by a printed circuit board, the activation pattern defining an activation surface that is pressed by an operator's finger in order to push the activation pattern in the direction of the electric switch. The activation pattern is made up of a set of studs that extend parallel to one another away from the electric switch, with the majority of the studs being spaced
(Continued)

apart from one another, the set of studs discontinuously delimiting an outer contour of the activation surface of the electronic push button.

14 Claims, 2 Drawing Sheets

(58) Field of Classification Search
USPC ..... 200/302.1, 302.2, 520, 341, 511, 512, 200/517, 518, 521, 552; 292/336.3
See application file for complete search history.

(56) References Cited

U.S. PATENT DOCUMENTS

| | | | | |
|---|---|---|---|---|
| 6,331,686 | B1 * | 12/2001 | Rogatschnig | H01H 13/08 200/302.2 |
| 6,621,027 | B1 * | 9/2003 | Shimizu | H01H 13/702 200/308 |
| 7,282,657 | B2 * | 10/2007 | Wimmer | B29C 45/16 200/302.1 |
| 7,576,631 | B1 | 8/2009 | Bingle et al. | |
| 8,258,418 | B2 * | 9/2012 | Chen | H01H 13/76 200/302.1 |
| 8,350,170 | B2 * | 1/2013 | Smidt | A47C 31/008 200/302.1 |
| 9,972,457 | B2 | 5/2018 | Kitahara | |
| 2004/0173446 | A1 | 9/2004 | Plana-Bague et al. | |
| 2006/0119113 | A1 | 6/2006 | Ishiguro | |
| 2011/0254290 | A1 | 10/2011 | Cho | |
| 2014/0338409 | A1 | 11/2014 | Kraus et al. | |
| 2015/0016144 | A1 | 1/2015 | Keist et al. | |
| 2015/0270076 | A1 * | 9/2015 | Katsuhara | G06F 3/0202 200/5 A |
| 2016/0376819 | A1 | 12/2016 | Bingle | |
| 2017/0178835 | A1 | 6/2017 | Freyermuth et al. | |

FOREIGN PATENT DOCUMENTS

| | | | |
|---|---|---|---|
| CN | 106997815 | A | 8/2017 |
| EP | 2886760 | A1 | 6/2015 |
| WO | 03021616 | A1 | 3/2003 |
| WO | 2016005177 | A1 | 1/2016 |

OTHER PUBLICATIONS

International Search Report and Written Opinion for International Application No. PCT/FR2018/050899, dated Jul. 17, 2018—10 pages.
Chinese Office Action for Chinese Application No. 201880031193.3, dated Jul. 27, 2020 with translation, 16 pages.
Chinese Office Action for Chinese Application No. 201880031193.3, dated Mar. 29, 2021, with translation, 17 pages.

* cited by examiner

ELECTRONIC PUSH BUTTON FOR A MOTOR VEHICLE DOOR HANDLE WITH ACTIVATION PATTERN MADE UP OF STUDS

CROSS REFERENCE TO RELATED APPLICATIONS

This application is the U.S. National Phase Application of PCT International Application No. PCT/FR2018/050899, filed Apr. 10, 2018, which claims priority to French Patent Application No. 1754182, filed May 12, 2017, the contents of such applications being incorporated by reference herein.

FIELD OF THE INVENTION

The present invention relates to an electronic push button for a motor vehicle door handle, comprising an activation pattern supported by a membrane that is flexible in the direction of an electric switch. This electronic push button is intended to be disposed inside a motor vehicle door handle.

The push button may serve, in association with a contactless key, to unlock a door of the vehicle when this key is located in the vicinity of the vehicle. The electronic push button serves as an alternative to locking or unlocking by a button on the key, the key then being external to the vehicle. The electronic push button is disposed inside the handle of a door of the motor vehicle, facing toward the motor vehicle so as not to be visible.

Such an electronic push button needs to be impermeable, given that it is located on a door handle on the outside of the vehicle. It should also be strong under activation and withstand a predetermined certain number of activations in accordance with production specifications.

The activation pattern carried by the electronic push button defines an activation surface that is pressed by an operator's finger in order to push the activation pattern in the direction of the electric switch.

BACKGROUND OF THE INVENTION

Such an electronic push button is known from the prior art, notably from the document EP-A-2 886 760, incorporated herein by reference, with an activation pattern in one piece. Such an electronic push button comprises a rigid activation pattern carried by a flexible membrane that flexes in the direction of an electric switch carried by a printed circuit, advantageously in the form of a board.

The electronic push button comprises a casing in which the printed circuit and the flexible membrane are inserted, the activation pattern protruding from the casing. The casing comprises at least one internal shoulder pointing toward the inside of the casing. This internal shoulder supports end portions of the flexible membrane. Preferably, this shoulder passes into a receiving housing carried by an end portion facing the membrane. A part of the membrane outside the casing forms a sealing cover covering the upper surface of the internal shoulder from outside the casing.

The activation pattern makes the membrane stiffer by increasing the activation forces to be exerted on the electronic push button. However, the application forces to which the activation pattern is subjected should remain within predetermined ranges and not be too high. In order to keep the activation forces within these predetermined ranges, the prior art chooses a membrane material with a low level of hardness so as to be more easily flexed toward the switch, hence a lower force to be applied to the activation pattern by an operator.

This has the well-known disadvantage that the membrane material chosen in the prior art is not robust enough to cope with a predetermined number of activations, for example but not necessarily 100,000 activations, this frequently being demanded in the production specifications relating to such an electronic push button.

Another requirement is that of obtaining contact between the membrane and the electric switch that is identifiable in a tactile manner by the operator, this only being possible by imposing a low actuating pressure on the activation pattern.

SUMMARY OF THE INVENTION

The problem underlying the present invention is, for an electronic push button intended to be housed in a motor vehicle door handle, to make the electronic push button easy to actuate while being able to withstand a high number of actuations defined by production specifications.

To this end, an aspect of the present invention relates to an electronic push button for a motor vehicle door handle, comprising an activation pattern supported by a membrane that is flexible in the direction of an electric switch carried by a printed circuit board, the activation pattern defining an activation surface that is pressed by an operator's finger in order to push the activation pattern in the direction of the electric switch, characterized in that the activation pattern is made up of a set of studs that extend parallel to one another away from the electric switch, with the majority of the studs being spaced apart from one another, the set of studs discontinuously delimiting an outer contour of the activation surface of the electronic push button. The set of studs comprises actuating studs and auxiliary studs, the actuating studs having a greater height than the auxiliary studs.

An aspect of the present invention proposes finding a solution to two requirements placed on the membrane, which should not only be flexible in order to be flexed easily but also be strong. An aspect of the present invention intends to limit the actuating force transmitted by the activation pattern to the membrane so as not to unduly stress the latter.

According to an aspect of the invention, the activation pattern is made up of a set of spaced-apart studs. The set of studs reproduces the outer contour of the activation pattern and, if appropriate, the inner contour of this activation pattern, if it is present.

The membrane supporting such an activation pattern made up of a set of studs will flex more easily under a smaller actuating force, while the centering of the operator's finger remains the same.

The technical effect is that an activation pattern is obtained that does not need to be pressed hard in order to flex the membrane toward the electric switch. Therefore, it is possible to use a more rigid membrane material, in order for example to withstand more than 100,000 activations while retaining the function of positioning the activation pattern and maintaining the activation forces, this favoring the endurance of the membrane while preserving an equivalent activation force. The activation force is low enough for the operator to feel the contact of the membrane with the electric switch. An aspect of the invention therefore makes the push button more robust while preserving its geometry allowing it to be kept in position in the door handle.

The three essential criteria of a motor vehicle door handle push button, namely impermeability, centering and the need to apply a relatively low pressing force, are complied with.

A lowering of the activation force exerted by the operator is thus obtained, this relating initially only to the actuating studs and is then applied to the other studs, which are the auxiliary studs. Thus, a pressure force is exerted in steps and the path that the auxiliary studs have to follow is reduced.

Advantageously at least one of the actuating studs, referred to as the main actuating stud, acts as a poka-yoke and as the main stud to be pressed by the operator's finger by having a larger dimension than the other actuating studs, the main actuating stud being positioned at one end of the activation surface and at least one actuating stud being positioned on the activation surface opposite the main actuating stud. The poka-yoke function applies both during the mounting of the push button in the motor vehicle door handle and also during the positioning of the operator's finger on the activation pattern.

Advantageously, an auxiliary stud is disposed on each side of the main actuating stud, each of these auxiliary studs forming an ear for the main actuating stud. The dimensions of the main actuating stud are increased and its strength is enhanced thereby, the pressure of the user's finger being applied mainly to this main actuating stud. The ears serve as lateral reinforcement for the main actuating stud.

Advantageously, with the main actuating stud and the ears thereof and, if appropriate, one or more auxiliary studs integral with the main actuating stud being considered to be a single actuating stud, each actuating stud is adjacent to an auxiliary stud in a manner spaced apart from this auxiliary stud by the spacing. This allows a balanced distribution of the actuating studs over the activation surface.

Advantageously, the set of studs is symmetric with respect to an axis extending in a plane containing the activation surface and passing through the main actuating stud equidistantly from the ears, two actuating studs referred to as opposite actuating studs being positioned symmetrically to said axis on the activation surface opposite the main actuating stud, each of the two opposite actuating studs having a respective auxiliary contour stud disposed next to its associated actuating stud on the side of the actuating stud opposite the main actuating stud, the two auxiliary contour studs defining a portion of the outer contour of the activation surface.

This axis corresponds advantageously to the median axis of the user's finger and symmetry around this axis is advantageous in order to receive a symmetrically distributed activation force.

Advantageously, the set of studs comprises, for the one part, three actuating studs, including a main actuating stud, and, for the other part, eight auxiliary studs, including two that form the ears of the main actuating stud and two others that are connected symmetrically to the main actuating stud, the four remaining auxiliary studs being studs spaced apart from at least one actuating stud.

Advantageously, the actuating studs have a height protruding from the flexible membrane of at least 3 to 4 mm, and the auxiliary studs have a height of between 2.5 mm and 2.9 mm, at least the actuating studs having a flat pressing surface at their free ends, the spacing between two studs being at least 0.6 mm.

The actuating studs are first of all pressed without the auxiliary studs being pressed then, ensuring the stepwise application of a pressure force, the auxiliary studs can also be pressed together with the actuating studs when the actuating studs have been curved through several tenths of a millimeter, then being at the height of the auxiliary studs.

Advantageously, at least some of the studs surround and delimit between one another a hollow cavity inside the activation surface, the flat pressing surface of each stud having a rounded edge facing the hollow cavity. This hollow cavity can serve to center the operator's finger with respect to the activation pattern, serving as a tactile identifier.

Advantageously, the material of the membrane is Santoprene™ TPV 121 60-M-200 or TPE thermolast® KTC5 PCN or TPE thermolast®) KTC5 PCZ.

In the context of the present invention, use can be made of any membrane material that allows it to flex while ensuring impermeability and the function of positioning and maintaining the activation pattern made up of a set of spaced-apart studs. The ease of pressing at least the actuating studs can make it possible to use a more rigid membrane that then has the advantage of being stronger.

BRIEF DESCRIPTION OF THE DRAWINGS

Further features, aims and advantages of aspects of the present invention will become apparent from reading the following detailed description and with reference to the appended drawings, which are given by way of nonlimiting examples and in which.

DETAILED DESCRIPTION OF THE PREFERRED EMBODIMENTS

Figure 1:
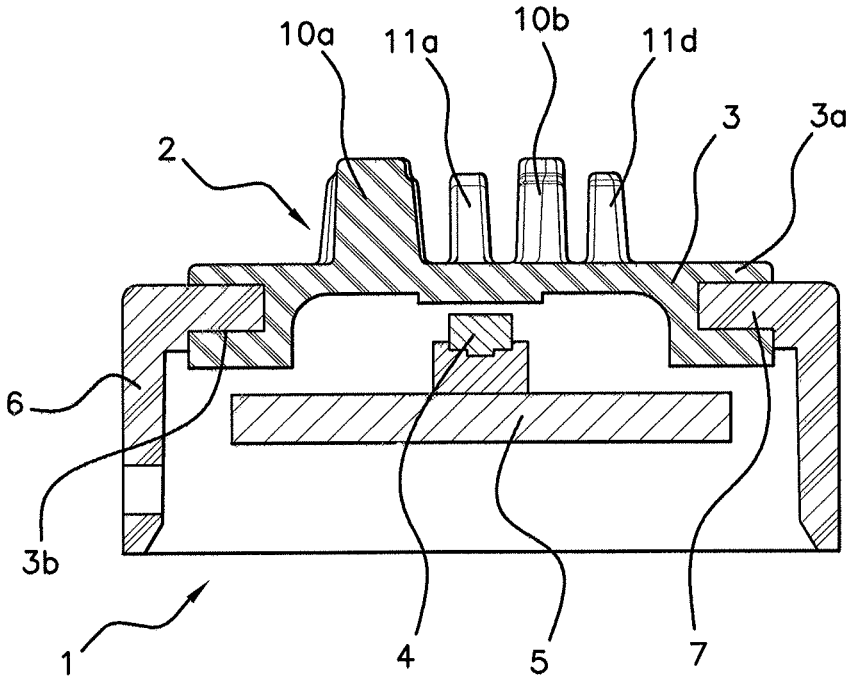
FIG. 1 is a schematic depiction of a cross-sectional view of one embodiment of an electronic push button according to an aspect of the present invention with a set of studs making up an activation pattern.

With reference to all the figures and notably to FIG. 1, an aspect of the present invention relates to an electronic push button 1 for a motor vehicle door handle, comprising an activation pattern 2 supported by a membrane 3 that is flexible in the direction of an electric switch 4 carried by a printed circuit board 5, the activation pattern 2 defining an activation surface that is pressed by an operator's finger in order to push the activation pattern 2 in the direction of the electric switch 4.

According to an aspect of the present invention, in order to allow the imposition of a lower pressing force while ensuring correct placement of the operator's finger on the activation pattern 2, and also to ensure the impermeability of the electronic push button 1, the activation pattern 2 is made up of a set of studs 10*a*, 10*b*, 11*a* to 11*d*. The studs of the set extend parallel to one another away from the electric switch 4, with the majority of the studs 10*a*, 11*a*, 10*b*, 11*d* being spaced apart from one another, the set of studs 10*a*, 10*b*, 11*a* to 11*d* discontinuously delimiting an outer contour of the activation surface of the electronic push button 1.

Away from the electric switch 4 means that the studs extend in the opposite direction to the electric switch 4, preferably in directions parallel to one another. This can be seen in FIG. 1.

In FIG. 1, the electronic push button 1 can reproduce the following features of a prior art electronic push button 1, these features not all being essential to an aspect of the present invention. The electronic push button 1 of an aspect of the present invention may comprise a casing 6 in which the printed circuit, the electric switch 4 thereof and the flexible membrane 3 are inserted, the activation pattern 2 protruding from the casing 6. The casing 6 comprises at least one internal shoulder 7 pointing toward the inside of the casing 6. This or these internal shoulders 7 support end portions of the flexible membrane 3. Preferably, this or these shoulders 7 pass into a respective receiving housing 3*b* carried by an end portion facing the membrane 3.

This or these shoulders 7 are located in the upper part of the casing 6 opposite a bottom therebeneath of the printed circuit board 5. The shoulder(s) 7 delimit a passage into the casing 6, this passage being closed by the membrane 3. A part of the membrane 3 outside the casing 6 forms a sealing cover 3*a* covering the passage and the contour thereof from the outside of the push button 1, and also covering a portion of the shoulder(s) 7. The impermeability of the inside of the casing 6 is thus ensured.

Embodiments of the studs and the positioning thereof will now be described in detail with reference more particularly to FIGS. 2 and 3. The set of studs 10*a*, 10*b*, 11*a* to 11*d* comprise actuating studs 10*a*, 10*b* and auxiliary studs 11*a* to 11*d*, the actuating studs having a greater height than the auxiliary studs 11*a* to 11*d*. The actuating studs 10*a*, 10*b* are the first of the studs to be in contact with the operator's finger. A smaller number of studs during the first contact allows the operator to exert a lower force than if he had to simultaneously press all the studs. The pressing force can thus be progressive.

At least one of the actuating studs 10*a*, 10*b*, referred to as the main actuating stud 10*a*, can act as a poka-yoke and as the main stud to be pressed by the operator's finger by having a larger dimension than the other actuating studs 10*b*. The main actuating stud 10*a* can be positioned at one end of the activation surface. In this case, at least one other actuating stud, referred to as the opposite actuating stud 10*b*, preferably two studs 10*b*, can be positioned on the activation surface substantially opposite the main actuating stud 10*a*.

Figure 2:
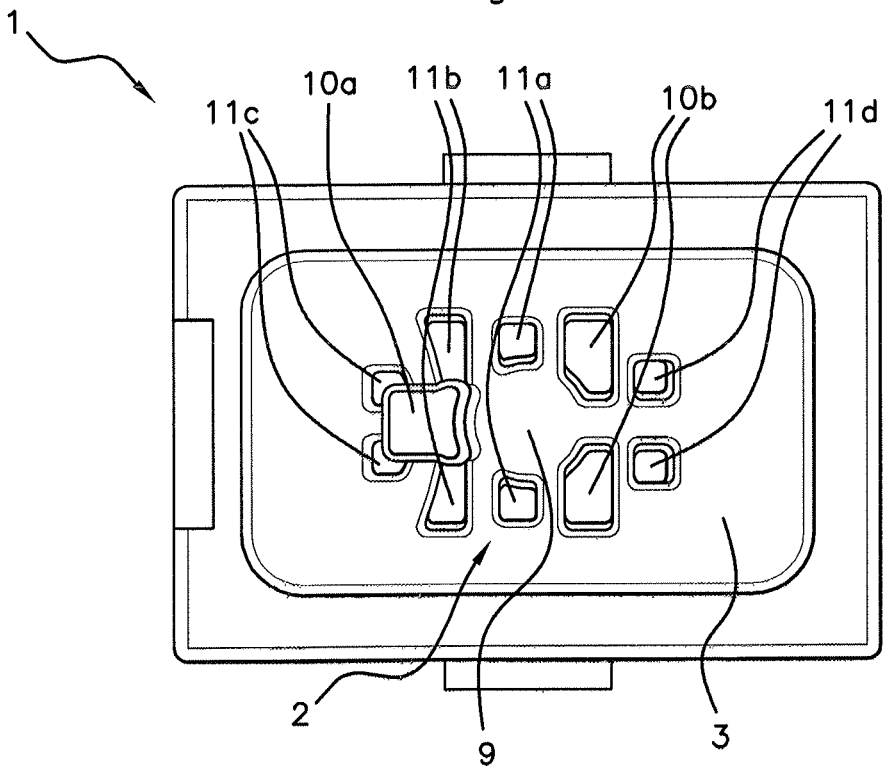
FIG. 2 is a schematic depiction of a top view of the embodiment of a push button shown in FIG. 1.

In FIG. 2, an auxiliary stud 11*b* can be disposed on each side of the main actuating stud 10*a*, i.e. two auxiliary studs 11*b* for the main actuating stud 10*a*. Each of these auxiliary studs 11*b* can form an ear for the main actuating stud 10*a*, each ear 11*b* protruding laterally beyond the main actuating stud 10*a*.

The auxiliary studs forming the ears 11*b* have a free-end surface with an elongate shape in the lateral direction of the main actuating stud 10*a*. The width of the ears 11*b* can increase with increasing distance from the main actuating stud 10*a*. These ears 11*b* help to keep the main actuating stud 10*a* in position, notably when a pressure is applied to a pressing surface at the free end thereof.

With the main actuating stud 10*a* and the ears 11*b* thereof and, if appropriate, one or more auxiliary studs 11*c* integral with the main actuating stud 10*a* being considered to be a single actuating stud 10*a*, that is to say not accounting for the auxiliary studs 11*b* and 11*c* integral with the main actuating stud 10*a*, each actuating stud 10*a*, 10*b* can be adjacent to an auxiliary stud 11*a*, 11*d* that is not integral with any actuating stud 10*a*, 10*b*. Each actuating stud 10*a*, 10*b* is thus separated from this non-integral auxiliary stud 11*a*, 11*d* by the above-mentioned spacing.

In FIG. 2, there are six spacings between actuating studs 10*a*, 10*b* and auxiliary studs 11*a*, 11*d*, and two spacings between two auxiliary studs referred to as auxiliary contour studs 11*d* that are each associated with an actuating stud 10*b* opposite the main actuating stud 10*a*. For the main actuating stud 10*a*, there are two spacings respectively between each ear 11*b* and a respective non-integral auxiliary stud 11*a*.

The set of studs 10*a*, 10*b*, 11*a* to 11*d* may be symmetric with respect to an axis extending in a plane containing the activation surface and passing through the main actuating stud 10*a* equidistantly from the ears 11*b*. In addition, as shown in FIG. 2, two actuating studs referred to as opposite actuating studs 10*b* can be positioned symmetrically to said axis on the activation surface opposite the main actuating stud 10*a*.

Each of the two opposite actuating studs 10*b* can have a respective auxiliary contour stud 11*d* disposed adjacent to its associated opposite actuating stud 10*b* on the side of the actuating stud 10*b* opposite the main actuating stud 10*a*. The auxiliary contour studs 11*d* are thus also symmetric with respect to said axis.

The two auxiliary contour studs 11*d* can define an outer contour portion of the activation surface. This is particularly visible in FIG. 3, which shows hatched surfaces corresponding to the contour of an activation pattern 2 according to the prior art.

As can be seen in FIG. 2, this is not limiting, however, the set of studs 10*a*, 10*b*, 11*a* to 11*d* can comprise three actuating studs 10*a*, 10*b*, including a main actuating stud 10*a* and two actuating studs 10*b* opposite the main actuating stud 10*a* on the activation surface. The set of studs 10*a*, 10*b*, 11*a* to 11*d* can also comprise eight auxiliary studs 11*a* to 11*d*, including two that form the ears 11*b* of the main actuating stud 10*a* and two other integral auxiliary studs 11*c* that are connected symmetrically to the main actuating stud 10*a*. The four remaining auxiliary studs 11*a*, 11*d* can be studs spaced apart from at least one actuating stud 10*a*, 10*b*.

The remaining auxiliary studs can be non-integral auxiliary studs 11*a*, 11*d* and can group together two non-integral auxiliary contour studs 11*d* defining a portion of the outer contour of the activation surface that are associated respectively with an actuating stud 10*b* opposite the main actuating stud 10*a*. The non-integral auxiliary studs 11*a*, 11*d* can also comprise two non-integral auxiliary studs 11*a*, each one of which is interposed between the main actuating stud 10*a* and a respective actuating stud 10*b* opposite the main actuating stud 10*a*.

Figure 3:
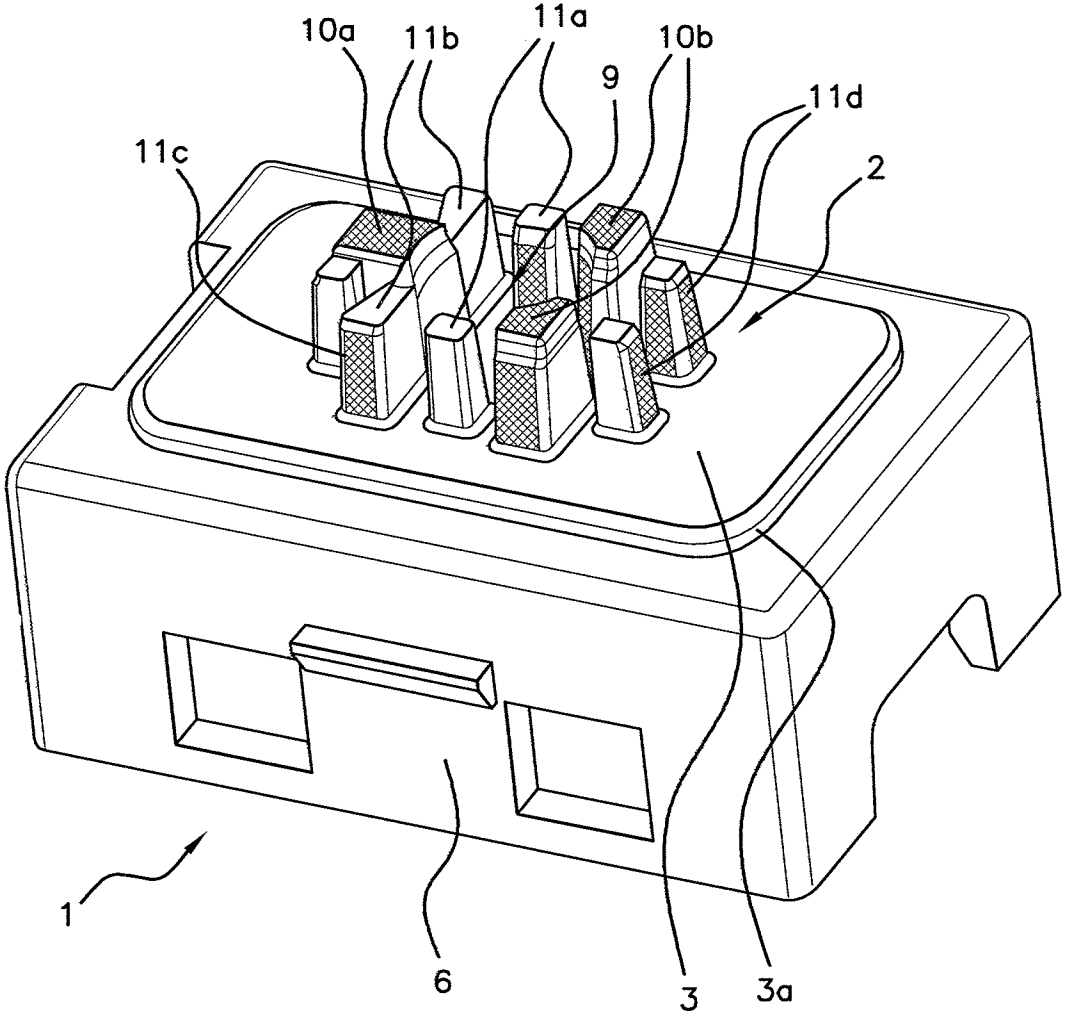
FIG. 3 is a schematic depiction of a perspective side view of the embodiment of a push button shown in FIGS. 1 and 2.

As can be seen by comparing the actuating studs 10*a*, 10*b* and the auxiliary studs 11*a* to 11*d* in FIGS. 1 and 3, the actuating studs 10*a*, 10*b* can have a height protruding from the flexible membrane 3 by at least 3 to 4 mm. The auxiliary studs 11*a* to 11*d* can have a height of between 2.5 mm and 2.9 mm. At least the actuating studs 10*a*, 10*b* can have a flat pressing surface at their free ends, the spacing between two studs 10*a*, 10*b*, 11*a* to 11*d* being at least 0.6 mm. This spacing distance is the minimum passage distance of a blade for separating two studs from one another.

Considering FIG. 3, the pressing surface of the main actuating stud 10*a* is substantially smaller than the two pressing surfaces of the actuating studs 10*b* opposite the main actuating stud 10*a*. As mentioned above, none of the auxiliary studs 11*a* to 11*d* has a pressing surface intended to be in contact with the operator's finger at the start of pressing of the activation pattern 2.

The studs 10*a*, 10*b*, 11*a* to 11*d* can be inclined slightly toward the interior of the activation surface, protruding from the membrane 3 supporting them. The deformation of the actuating studs 11*a*, 10*b* when a pressure is applied thereto can be taken into account, and this can translate into a specific configuration. The base of the studs 10*a*, 10*b*, 11*a* to 11*d* resting on the membrane 3 can be for example larger than the pressure surface at their free ends.

At least some of the studs 10*a*, 10*b*, 11*a* can surround and delimit between one another a hollow cavity 9 inside the activation surface. There may be three actuating studs 10*a*, 10*b* and two non-integral auxiliary studs 11*a* located respectively between a main actuating stud 10*a* and one of the two opposite actuating studs 11*b*. In this case, the flat pressing surface of each of these studs 10*a*, 10*b*, 11*a* can have a rounded edge facing the hollow cavity 9. This is applicable to the actuating studs 10*a*, 10*b* and to the non-integral auxiliary studs 11*a*, thus apart from the auxiliary contour studs 11*d* opposite the main actuating stud 10*a* and the integral auxiliary studs 11*b* forming the ears 11*b* and the two other auxiliary studs 11*c* integral with the main actuating stud 10*a*.

With such an activation pattern 2 having a set of studs 10*a*, 10*b*, 11*a* to 11*d*, it is possible to choose a stronger membrane material 3. The following criteria that can be taken into consideration are essentially the tensile strength, the elongation at break and the result of a compression test.

In one embodiment, the material of the membrane 3 can be Santoprene™ TPV 121 60-M-200. This vulcanized thermoplastic material can be injection-molded and has in particular a Shore hardness of 61, a tensile strength of 3.90 megapascals at 23° C. and an elongation at break of 360% at a temperature of 23° C. and a percentage of 54% in a compression test when held at 125° C. for 70 hours.

In another embodiment, the material of the membrane 3 can be TPE thermolast® KTC5 PCN. This vulcanized thermoplastic material can be injection-molded and has in particular a Shore hardness of 47, a tensile strength of 4 megapascals at 23° C., an elongation at break of 350% at a temperature of 23° C. and a percentage of 45% in a compression test when held at 100° C. for 24 hours.

A membrane 3 made of TPE thermolast® KTC5 PCZ can also be used. Generally, a choice can be made between the plastics materials having a percentage greater than 35% in a compression test when held at 125° C. for 70 hours and a tensile strength greater than 3.5 megapascals at 23° C.

A membrane 3 according to the prior art was often made of Santoprene™ TPV 82 11-35. This plastics material has in particular a Shore hardness of 38, a tensile strength of 2.90 megapascals at 23° C., thus lower than the minimum limit of 3.5 megapascals for a plastics material able to form the membrane 3, an elongation at break of 350% at a temperature of 23° C. and a percentage of 36% in a compression test when held at 125° C. for 70 hours.

An aspect of the invention also relates to a motor vehicle door handle, comprising such an electronic push button 1 as control element for locking the door.

Such an electronic push button 1 can be manufactured by injection-molding from plastics material the set of studs 10*a*, 10*b*, 11*a* to 11*d* producing the activation pattern 2, the injection-molding operation being able to start with the main actuating stud 10*a*, at least one auxiliary stud being separated from an actuating stud 10*a*, 10*b* by passing a blade between said studs and creating a spacing therebetween.

The invention claimed is:

1. An electronic push button for a motor vehicle door handle, comprising:

an activation pattern supported by a membrane that is flexible in a direction of a printed circuit board that carries a single electric switch, the activation pattern defining an activation surface that is pressed by a finger of an operator in order to actuate the single electric switch by pushing the activation pattern in the direction of the printed circuit board, the activation pattern being made up of a set of studs that extend parallel to one another away from the electric switch, with a majority of the studs being spaced apart from one another, the set of studs discontinuously delimiting an outer contour of the activation surface of the electronic push button, wherein the set of studs comprises actuating studs and auxiliary studs, the actuating studs having a greater height than the auxiliary studs, the actuating studs configured to be pressed by the finger of the operator in order to actuate the single electric switch by pushing the activation pattern in the direction of the printed circuit board, the activation pattern usable to actuate only the single electric switch carried by the printed circuit board.

2. The electronic push button as claimed in claim 1, wherein at least one of the actuating studs, referred to as a main actuating stud, acts as a poka-yoke and as a main stud to be pressed by the finger of the operator by having a larger dimension than other actuating studs, the main actuating stud being positioned at one end of the activation surface and at least one actuating stud being positioned on the activation surface opposite the main actuating stud.

3. The electronic push button as claimed in claim 2, wherein an auxiliary stud is disposed on each side of the main actuating stud, each of these auxiliary studs forming an ear for the main actuating stud.

4. The electronic push button as claimed in claim 3, wherein the main actuating stud and the ears thereof and optionally one or more auxiliary studs integral with the main actuating stud constitute a single actuating stud, and wherein each actuating stud is adjacent to an auxiliary stud in a manner spaced apart from this auxiliary stud by the spacing.

5. The electronic push button as claimed in claim 4, wherein the set of studs is symmetric with respect to an axis extending in a plane containing the activation surface and passing through the main actuating stud equidistantly from the ears, two actuating studs referred to as opposite actuating studs being positioned symmetrically to said axis on the activation surface opposite the main actuating stud, each of the two opposite actuating studs having a respective auxiliary contour stud disposed next to its associated opposite actuating stud on a side of the actuating stud opposite the main actuating stud, the two auxiliary contour studs defining a portion of the outer contour of the activation surface.

6. The electronic push button as claimed in claim 4, wherein the set of studs comprises, for one part, three actuating studs, including a main actuating stud, and, for another part, eight auxiliary studs, including two that form the ears of the main actuating stud and two other auxiliary studs that are connected symmetrically to the main actuating stud, four remaining auxiliary studs being studs spaced apart from at least one actuating stud.

7. The electronic push button as claimed in claim 3, wherein the set of studs is symmetric with respect to an axis extending in a plane containing the activation surface and passing through the main actuating stud equidistantly from the ears, two actuating studs referred to as opposite actuating studs being positioned symmetrically to said axis on the activation surface opposite the main actuating stud, each of the two opposite actuating studs having a respective auxiliary contour stud disposed next to its associated opposite actuating stud on a side of the actuating stud opposite the main actuating stud, the two auxiliary contour studs defining a portion of the outer contour of the activation surface.

8. The electronic push button as claimed in claim 3, wherein the set of studs comprises, for one part, three actuating studs, including a main actuating stud, and, for another part, eight auxiliary studs, including two that form ears of the main actuating stud and two other auxiliary studs that are connected symmetrically to the main actuating stud, four remaining auxiliary studs being studs spaced apart from at least one actuating stud.

9. The electronic push button as claimed in claim 2, wherein the set of studs comprises, for one part, three actuating studs, including a main actuating stud, and, for another part, eight auxiliary studs, including two that form ears of the main actuating stud and two other auxiliary studs that are connected symmetrically to the main actuating stud, four remaining auxiliary studs being studs spaced apart from at least one actuating stud.

10. The electronic push button as claimed in claim 2, wherein the set of studs is symmetric with respect to an axis extending in a plane containing the activation surface and passing through the main actuating stud equidistantly from ears, two actuating studs referred to as opposite actuating studs being positioned symmetrically to said axis on the activation surface opposite the main actuating stud, each of the two opposite actuating studs having a respective auxiliary contour stud disposed next to its associated opposite actuating stud on a side of the actuating stud opposite the main actuating stud, the two auxiliary contour studs defining a portion of the outer contour of the activation surface.

11. The electronic push button as claimed in claim 10, wherein the set of studs comprises, for one part, three actuating studs, including a main actuating stud, and, for another part, eight auxiliary studs, including two that form ears of the main actuating stud and two other auxiliary studs that are connected symmetrically to the main actuating stud, four remaining auxiliary studs being studs spaced apart from at least one actuating stud.

12. The electronic push button as claimed in claim 1, wherein the actuating studs have a height protruding from the flexible membrane of at least 3 to 4 mm, and the auxiliary studs have a height of between 2.5 mm and 2.9 mm, at least the actuating studs having a flat pressing surface at their free ends, the spacing between two studs being at least 0.6 mm.

13. The electronic push button as claimed in claim 12, wherein at least two of the studs surround and delimit between one another a hollow cavity inside the activation surface, the flat pressing surface of each stud having a rounded edge facing the hollow cavity.

14. The electronic push button as claimed in claim 1, wherein a material of the membrane is thermoplastic.

* * * * *